US008505192B2

(12) United States Patent
Chu

(10) Patent No.: US 8,505,192 B2
(45) Date of Patent: Aug. 13, 2013

(54) MANUFACTURING METHOD OF COMMON MODE FILTER

(75) Inventor: Chung-Ming Chu, Tainan (TW)

(73) Assignee: Advance Furnace Systems Corp., Tainan (TW)

( * ) Notice: Subject to any disclaimer, the term of this patent is extended or adjusted under 35 U.S.C. 154(b) by 0 days.

(21) Appl. No.: 13/248,075

(22) Filed: Sep. 29, 2011

(65) Prior Publication Data

US 2012/0086538 A1 Apr. 12, 2012

(30) Foreign Application Priority Data

Oct. 8, 2010 (TW) ..... 99134307 A
Nov. 10, 2010 (TW) ..... 99221800 U

(51) Int. Cl.
*H01F 7/06* (2006.01)

(52) U.S. Cl.
USPC ..... 29/602.1; 29/592.1; 29/729; 29/876; 310/348; 310/340; 310/344; 333/181; 333/185; 333/200

(58) Field of Classification Search
USPC ..... 29/592.1, 729, 739, 758, 764, 876; 310/313, 340, 344, 348; 333/185, 181, 200
See application file for complete search history.

(56) References Cited

U.S. PATENT DOCUMENTS

| | | | | |
|---|---|---|---|---|
| 5,552,756 | A * | 9/1996 | Ushiro | 336/200 |
| 5,616,960 | A * | 4/1997 | Noda et al. | 257/760 |
| 6,376,912 | B1 * | 4/2002 | Seto | 257/760 |
| 6,384,705 | B1 * | 5/2002 | Huang et al. | 336/200 |
| 6,713,162 | B2 * | 3/2004 | Takaya et al. | 428/209 |
| 6,998,939 | B2 * | 2/2006 | Nakayama et al. | 333/181 |

* cited by examiner

*Primary Examiner* — Paul D Kim
(74) *Attorney, Agent, or Firm* — Rosenberg, Klein & Lee

(57) ABSTRACT

A manufacturing method of common mode filters and a structure of the same are revealed. A common mode choke layer is disposed over a composite substrate and a second magnetic material layer is coated on an upper surface of the common mode choke layer. The common mode choke layer is produced by a wafer-level electrode leading out method and having leading-out terminals on sides thereof. External electrodes are formed on sides of the common mode choke layer by partial cutting, sputtering, lithography and electroplating at wafer level and corresponding to the leading-out terminals. Thereby common mode filters produced are supported more stably. Moreover, the volume is minimized due to inductive coils and external electrodes connected by wafer level packaging. Thus the common mode filters are mass-produced, the cost is down and the defect rate is reduced.

7 Claims, 14 Drawing Sheets

MANUFACTURING METHOD OF COMMON MODE FILTER

BACKGROUND OF THE INVENTION

1. Field of the Invention

The present invention relates to a manufacturing method of common mode filters and a structure of the same, especially to a common mode filter that provides more stable support by a composite substrate and connects inductive coils with external electrodes by wafer scale packaging techniques for minimization of the volume. Once the common mode filters are of compact size, they can be mass-produced, the cost is reduced and the defect rated is decreased. At the same time, the connection and conduction between the inductive coils and the external electrode are more convenient and easier. The common mode filters are of higher practical value and the manufacturing method thereof is novel.

2. Description of Related Art

Due to compact design of various electronics such as mobile phones, cameras, etc. for easy carrying, electronic components are required to have compact volume, with high performance and high frequency. The manufacturing of the minimized components is difficult. As to small-sized common mode filters, as disclosed in U.S. Pat. No. 7,023,299 B2 published on Apr. 4, 2006, a thin-film common mode filter includes a pair of magnetic plates, and upper/lower coil conductors that are formed between the magnetic plates, spirally wound in the magnetic plate surface direction, and overlapped each other, and upper/lower lead conductors. One ends of the upper/lower lead conductors are connected electrically to one ends in centers of the upper/lower coil conductors respectively, and extended to external portions across these coil conductors. The other ends of the upper/lower lead conductors are connected to upper/lower lead drawing terminals respectively. And each of the lower lead/coil drawing terminals and the upper coil/lead drawing terminals has a structure in which at least two of conductor layers that are patterned into the upper/lower lead conductors and the upper/lower coil conductors are stacked and brought into conduction with each other.

Although the above common mode filter provides expected effects, it still has problems. In practice, a plurality of common mode filters are arranged in a sheet during manufacturing processes first and are cut into individuals by cutting tools. Then external electrodes are produced on outer sides of each common mode filter by silver dipping. However, a magnetic composite substrate of the common mode filter is easy to get cracked during clamping of manufacturing processes due to weak strength. And during the cutting process, the common mode filters are easy to get damaged and this results in additional cost/loss. Furthermore, the external electrodes are produced by silver dipping and are connected to leading-out terminals after cutting. For volume minimization, the relative size of the common mode filer is about 1.0 mm×0.5 mm×0.4 mm. Thus the formation of the external electrodes requires high precision techniques. Moreover, reliability of the external electrode is a problem. There is room for improvement and a need to provide a manufacturing method of common mode filters and a structure of the same having higher practical value.

SUMMARY OF THE INVENTION

Therefore it is a primary object of the present invention to provide a manufacturing method of common mode filters and a structure of the same. The common mode filter includes a composite substrate and a common mode choke layer produced by a wafer-level electrode leading out method. The composite substrate consists of a baser layer with an adhesive layer and a first magnetic material layer arranged over the adhesive layer. The base layer and the first magnetic material layer are sintered and connected by the adhesive layer. The common mode choke layer is composed of a plurality of inductive coils and a plurality of insulated layers while the inductive coil includes at least a pair of leading-out terminals located on sides thereof. Moreover, a second magnetic material layer is coated on an upper surface of the common mode choke layer. Then by partial cutting, sputtering, lithography, and electroplating at wafer level, external electrodes are formed on sides of the common mode choke layer, corresponding to the leading-out terminals. Thereby the composite substrate has more stable support. The volume of the common mode filter is minimized due to the inductive coils and external electrodes connected by wafer level packaging. Thus the common mode filter becomes compact and easy to be mass-produced. The cost is down and the rejection rate is also reduced. At the same time, the inductive coils and the external electrodes are connected by packaging techniques such as sputtering, lithography and electroplating at wafer level. The reliability problem of the electrodes produced by conventional silver plating is reduced. The common mode filter of the present invention is of higher practical value.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
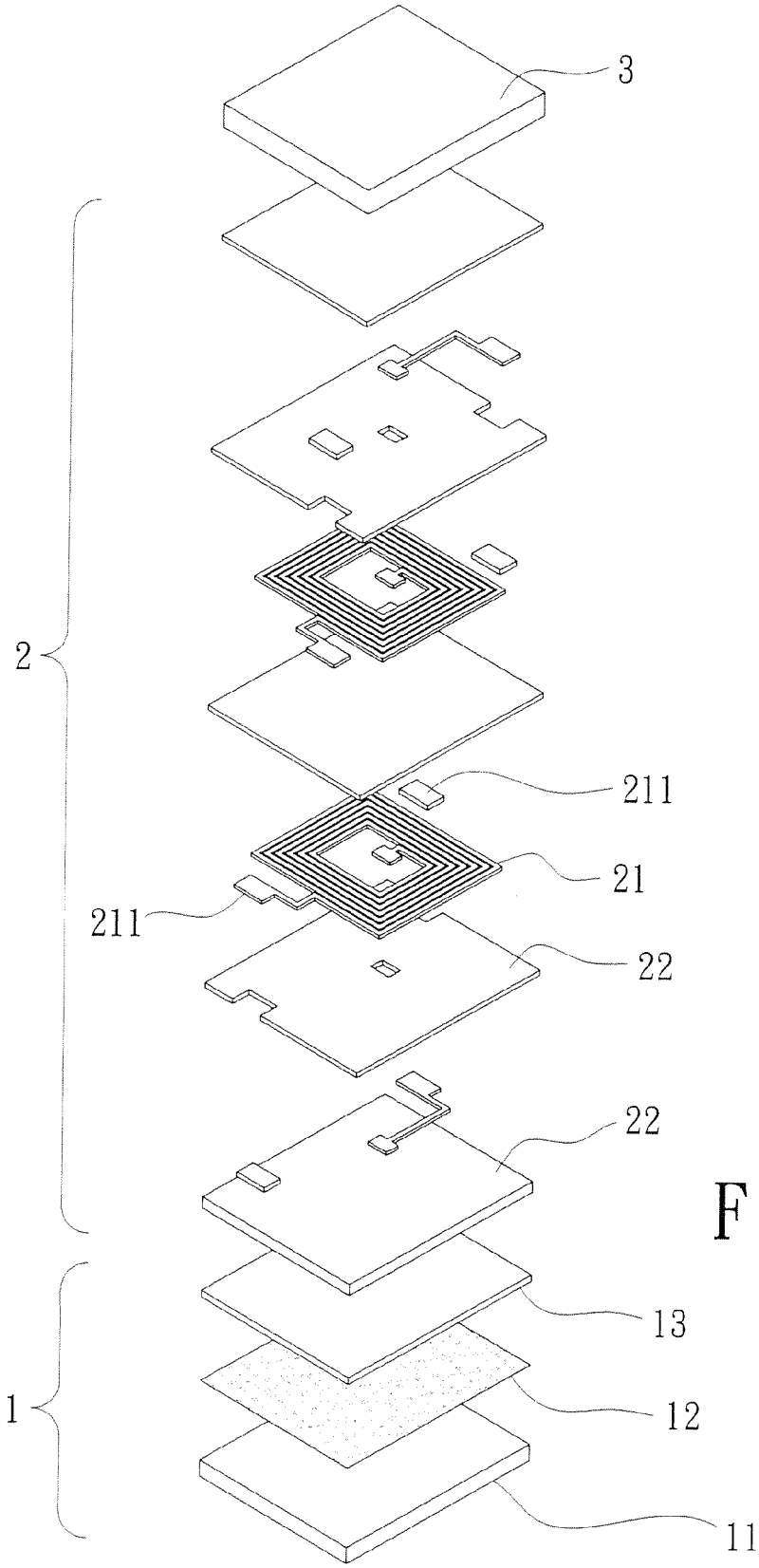
FIG. 1 is an explosive view of an embodiment according to the present invention.

Refer to FIG. 1, a common mode filter of the present invention mainly includes a composite substrate 1, a common mode choke layer 2, and a second magnetic material layer 3.

Figure 2:
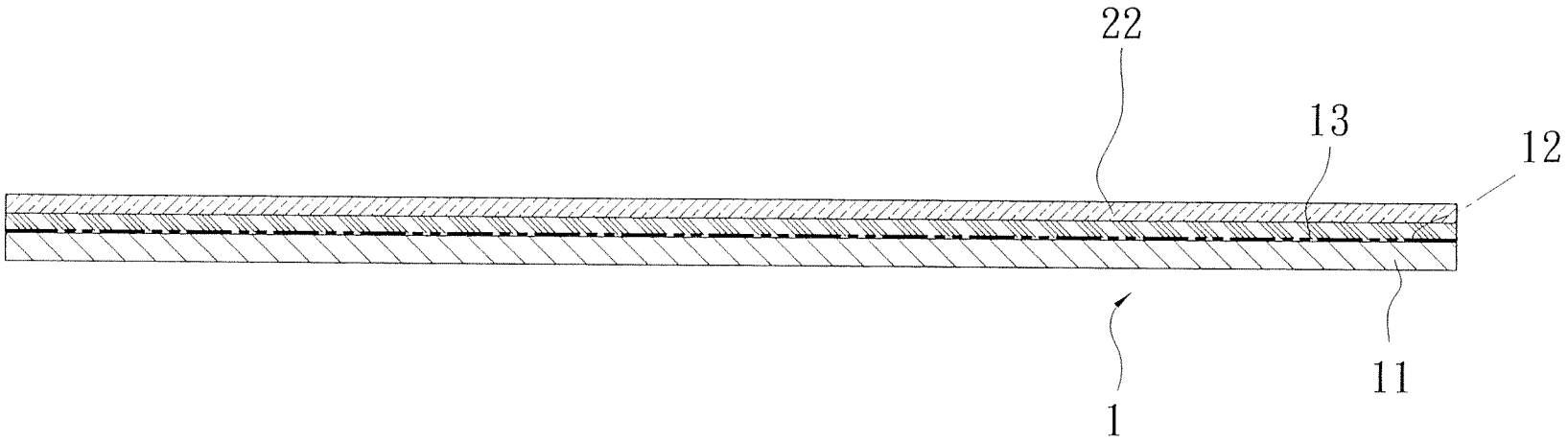
FIG. 2 is a cross sectional view of an embodiment of an assembled composite substrate according to the present invention.

Refer to FIG. 2, the composite substrate 1 consists of a base layer 11 made from alumina ($Al_2O_3$), or silicon (Si) and an adhesive layer 12 disposed over the base layer 11. The adhesive layer 12 is coated with a first magnetic material layer 13. In consideration of the flatness, the first magnetic material layer 13 is made from magnetic material whose particle size is smaller than 10 μm. And the thickness of the first magnetic material layer 13 ranges from 20 μm to 80 μm. The base layer 11 and the first magnetic material layer 13 are sintered and connected with each other by the adhesive layer 12.

The common mode choke layer 2 is composed of a plurality of inductive coils 21 and a plurality of insulated layers 22. The inductive coil 21 includes at least a pair of leading-out terminals 211.

The second magnetic material layer 3 is coated on a surface of the common mode choke layer 2 for increasing resistance of the common mode filter. The particle size of the second magnetic material layer 3 ranges from 30 μm to 80 μm while the thickness of the second magnetic material layer 3 is about 50~150 μm. The larger the particle size of the material the second magnetic material layer 3 made from, the higher the permeability.

Figure 3:
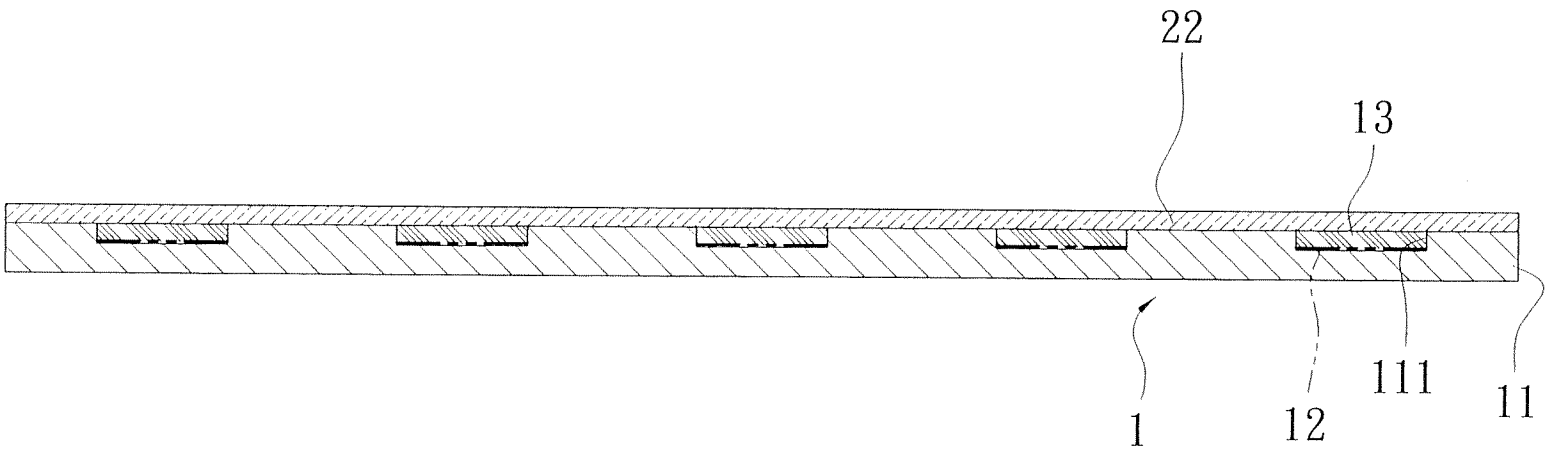
FIG. 3 is a cross sectional view of another embodiment of an assembled composite substrate according to the present invention.

Moreover, refer to a cross sectional view of another embodiment of the present invention shown in FIG. 3, a composite substrate 1 includes a base layer 11 and a plurality of receiving slots 111 arranged at the base layer 11. An adhesive layer 12 is set inside each receiving slot 111. A first magnetic material layer 13 is disposed over the adhesive layer 12 inside the receiving slot 111. Thus the base layer 11 is sintered and connected to the first magnetic material layer 13 by the adhesive layer 12 inside each receiving slot 111.

Figure 4:
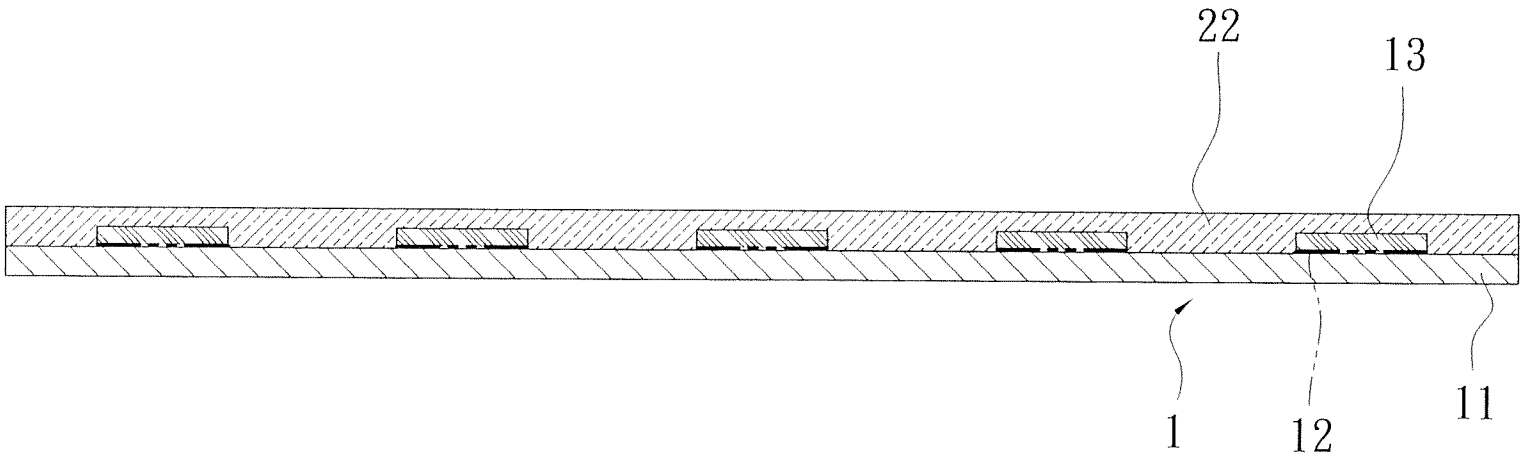
FIG. 4 is a cross sectional view of a further embodiment of an assembled composite substrate according to the present invention.

Refer to FIG. 4, a further embodiment of a composite substrate of the present invention is revealed. The composite substrate 1 includes a base layer 11, a plurality strips of first magnetic material layer 13 disposed over the base layer 11 and an adhesive layer 12 arranged between the base layer 11 and respective first magnetic material layer 13. The base layer 11 and the first magnetic material layers 13 are also sintered and connected by the adhesive layer 12.

Figure 5:
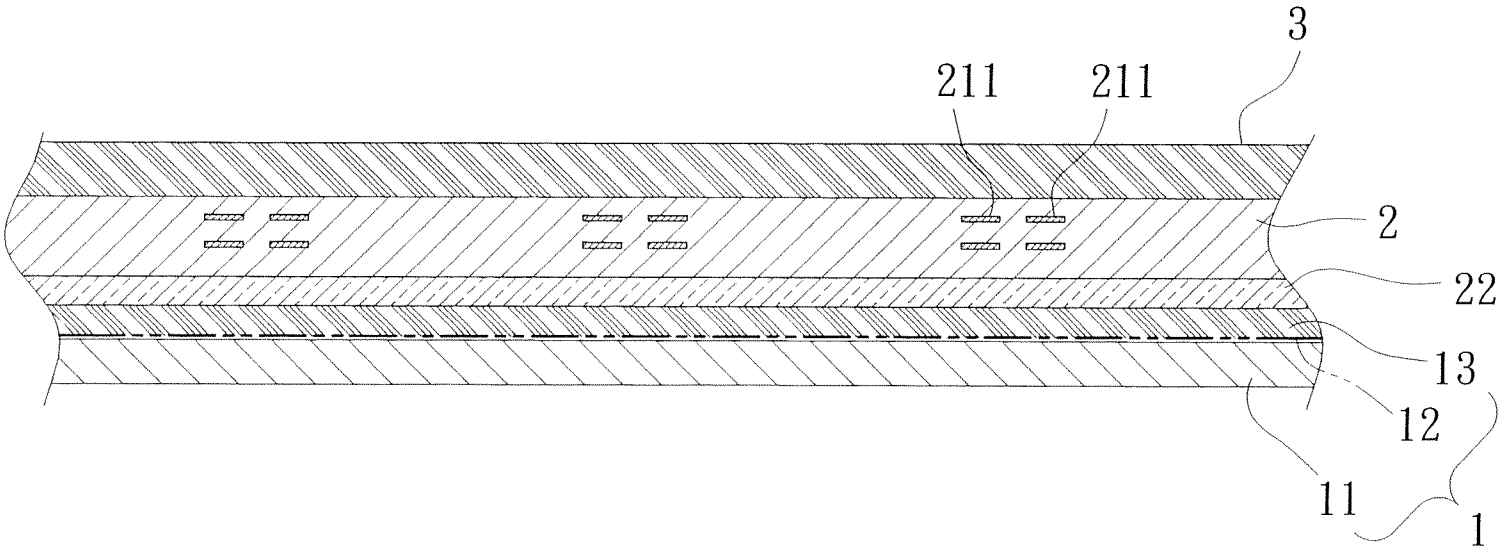
FIG. 5 is a schematic drawing showing manufacturing of an embodiment according to the present invention.
Figure 6:
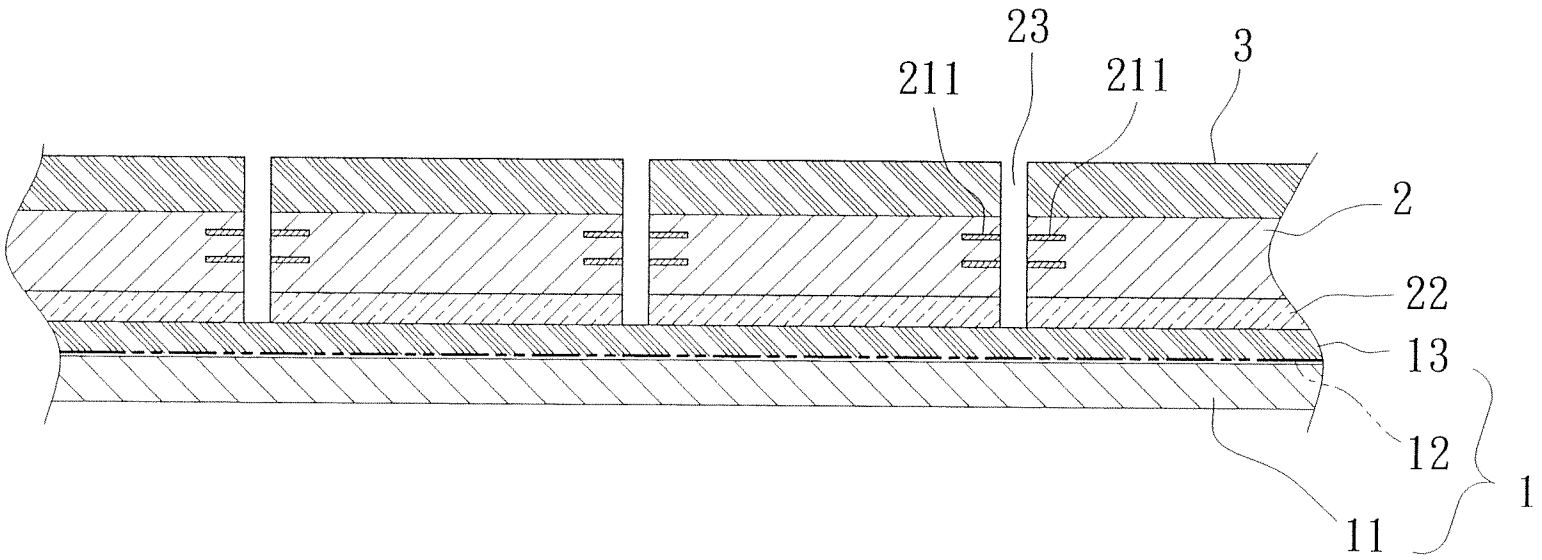
FIG. 6 is another schematic drawing showing manufacturing of an embodiment according to the present invention.
Figure 7:
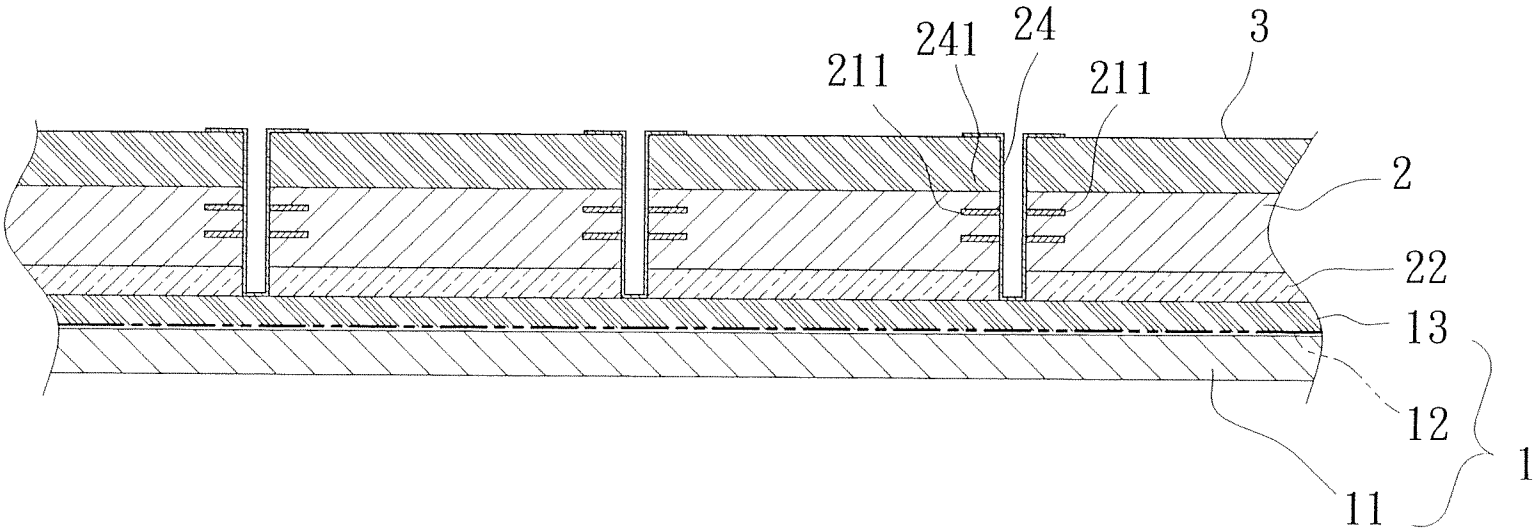
FIG. 7 is a further schematic drawing showing manufacturing of an embodiment according to the present invention.
Figure 8:
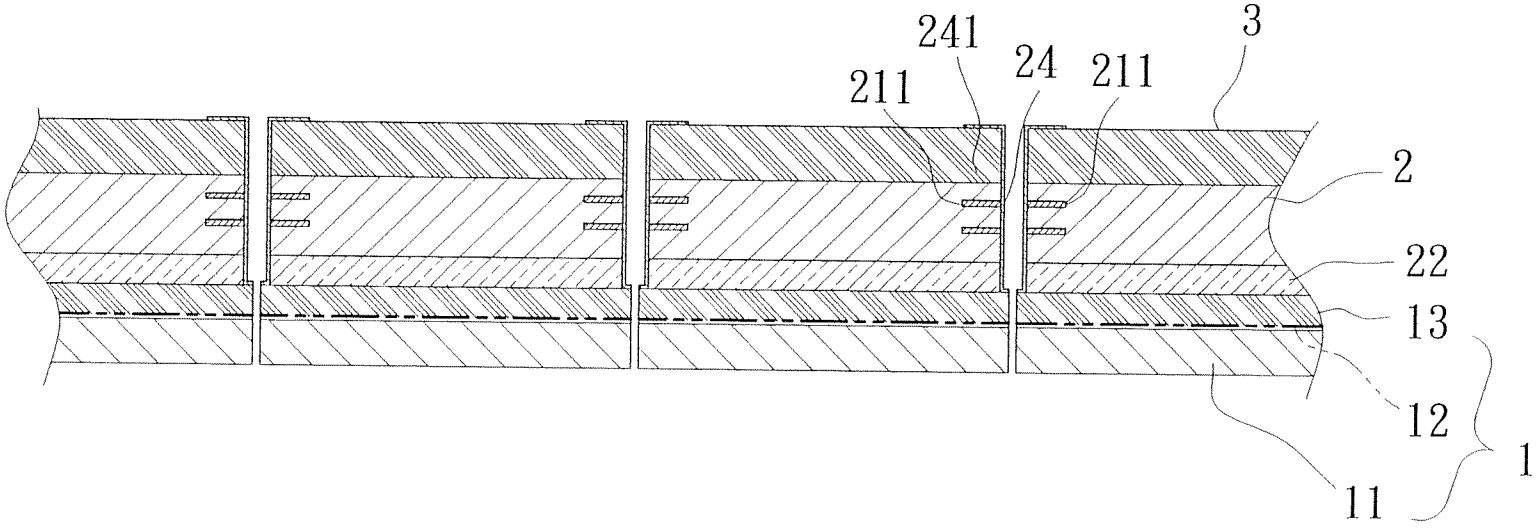
FIG. 8 is a further schematic drawing showing manufacturing of an embodiment according to the present invention.
Figure 9:
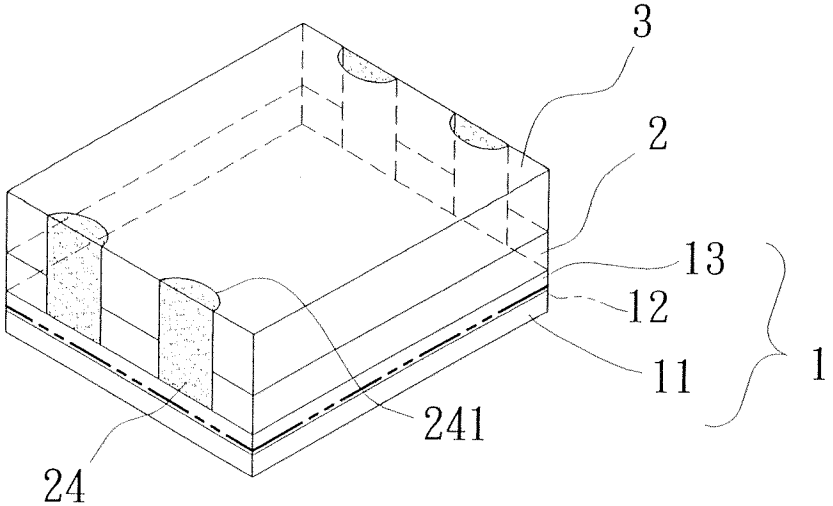
FIG. 9 is a perspective view of an embodiment according to the present invention.

Refer to FIG. 5, a schematic drawing showing formation of a common mode filter of the present invention is disclosed. During manufacturing, a plurality of common mode filters forms a wafer and then perform a first cutting by means of a cutting tool. A groove 23 is formed between two common mode filters by partial cutting. The cutting tool cuts a second magnetic material layer 3 and a common mode choke layer 2, allowing leading-out terminals 211 located on sides of the common mode choke layer 2, as shown in FIG. 6. Then the wafer is processed by sputtering, lithography, electroplating and stripping. A sputtering seed layer is made from titanium tungsten alloy/copper (tiw/cu). In lithography, a layer of photoresist material is coated on a surface of the wafer and the area coated with photoresistor will not be electroplated. The electroplating process is for coating cu/ni/au or cu/ni/sn. After stripping, the exposed seed layer (tiw/cu or ti/cu) is etched directly on the wafer so that conductive material is coated on the sides of the common mode choke layer 2 to form external electrodes 24. The above steps are associated with wafer level packaging techniques. The external electrode 24 is connected to the leading-out terminal 211 of the common mode choke layer 2 and the external electrode 24 extends to an upper surface of the second magnetic material layer 3 to form a conductive part 241, as shown in FIG. 7. At last, use laser to cut the composite substrate 1 along the groove 23, as shown in FIG. 8. Refer to FIG. 9. Thus the manufacturing of respective common mode filter is completed.

The groove 23 is formed on the common mode choke layer 2 by the cutting tool and then the external electrode 24 is formed in the groove 23 by sputtering, lithography, electroplating and stripping at wafer level. While performing the first cutting, the cutting tool is not easily damaged because the common mode choke layer 2 is made from resin. As to the second cutting, the cutting tool is replaced by a laser beam to cut the composite substrate 1. Thus the damages of cutting tools during manufacturing processes are minimized and the additional cost is significantly lowered.

Figure 10:
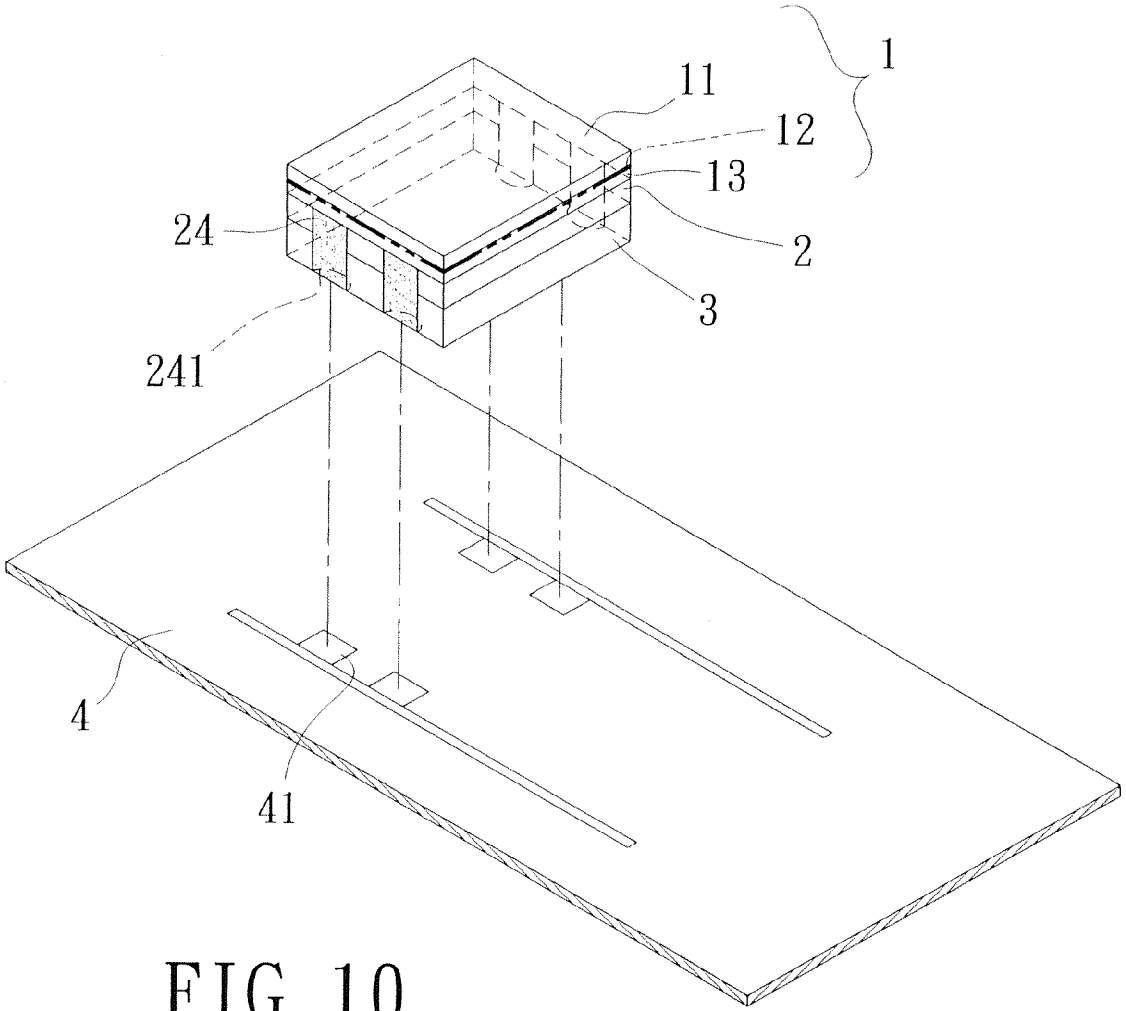
FIG. 10 is a schematic drawing showing an embodiment of the present invention in use.

Refer to FIG. 10, in use, the common mode filter is soldered and connected to terminals 41 of a circuit board 4 by the conductive parts 241 extended from the external electrodes 24 so as to achieve expected effects. The external electrode 24 is corresponding to the leading-out terminals 211 and formed by coating of the sides of the common mode choke layer 2.

Figure 11:
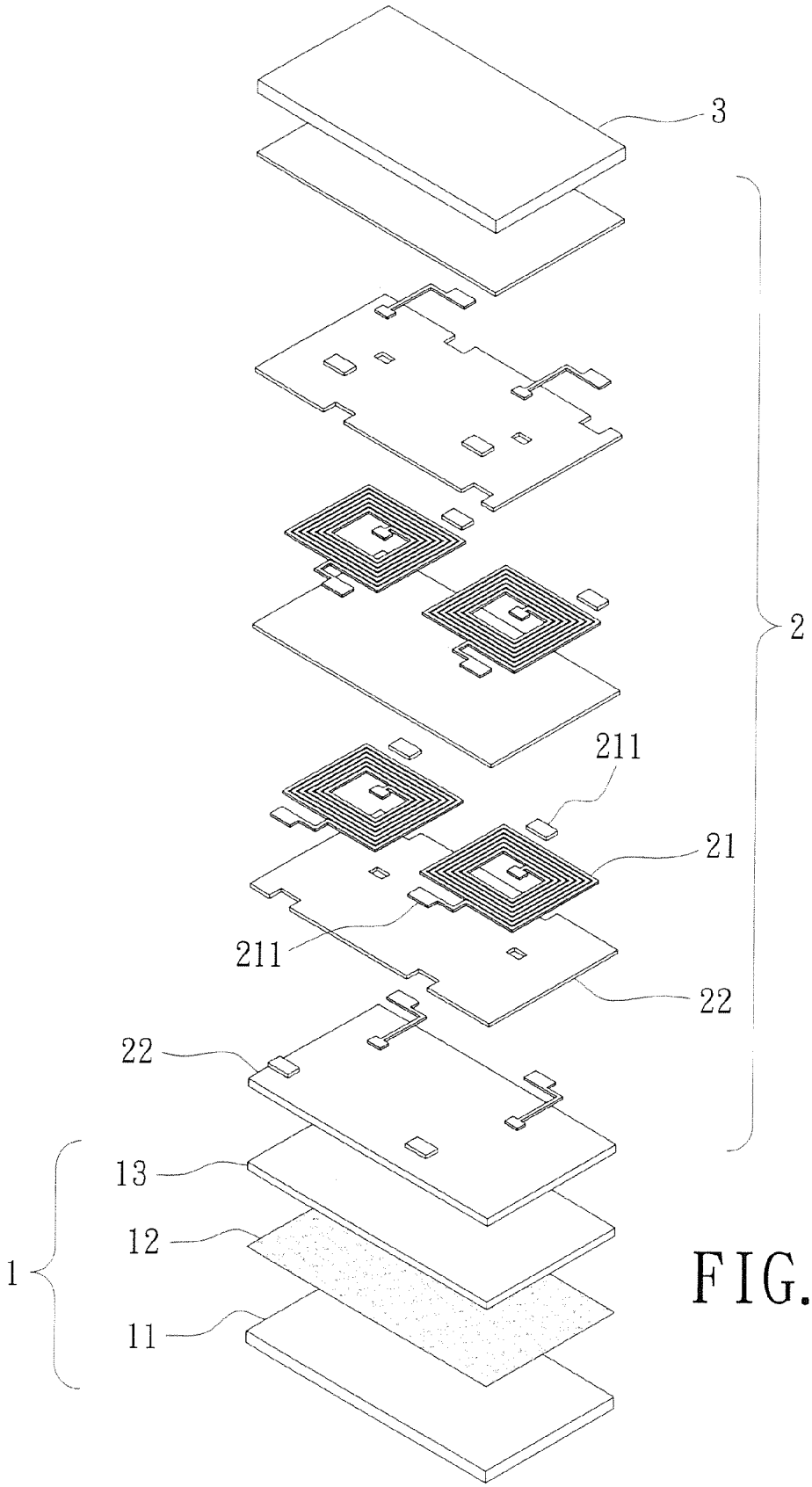
FIG. 11 is an explosive view of an embodiment according to the present invention.
Figure 12:
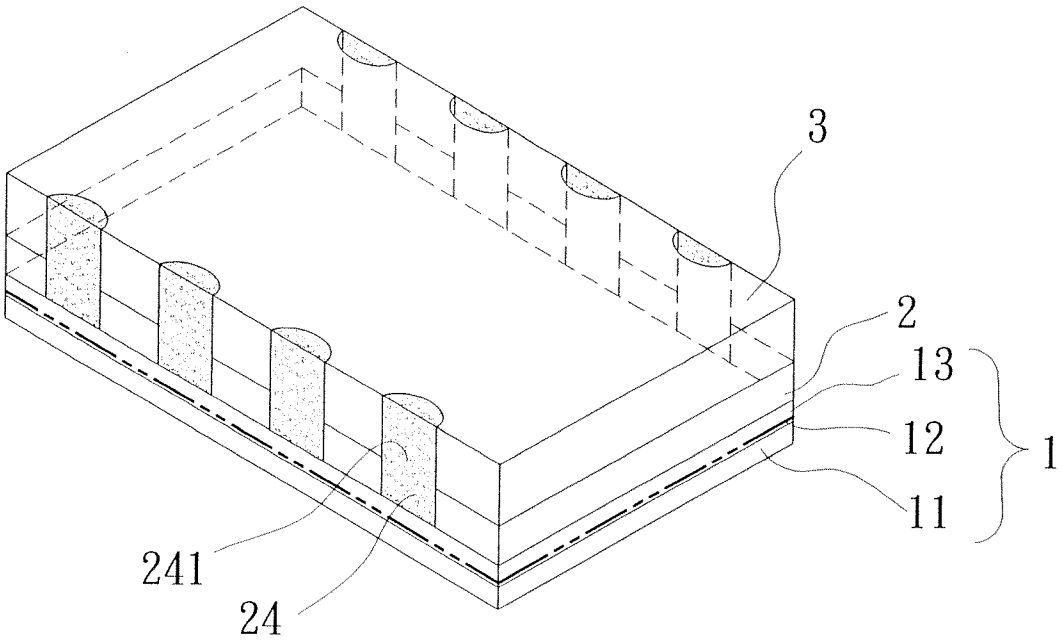
FIG. 12 is a perspective view of an embodiment according to the present invention.

Refer to FIG. 11 and FIG. 12, the inductive coils 21 are arranged between the insulated layers 22 of the common mode choke layer 2 in different ways according to various requirements in use. For example, each insulated layer 22 is disposed with a single set of the inductive coils 21 or is arranged with a plurality sets of the inductive coils 21. And the number of the external electrode 24 is increased along with the increasing number of the inductive coils 21 arranged at each insulated layer 22.

Figure 13:
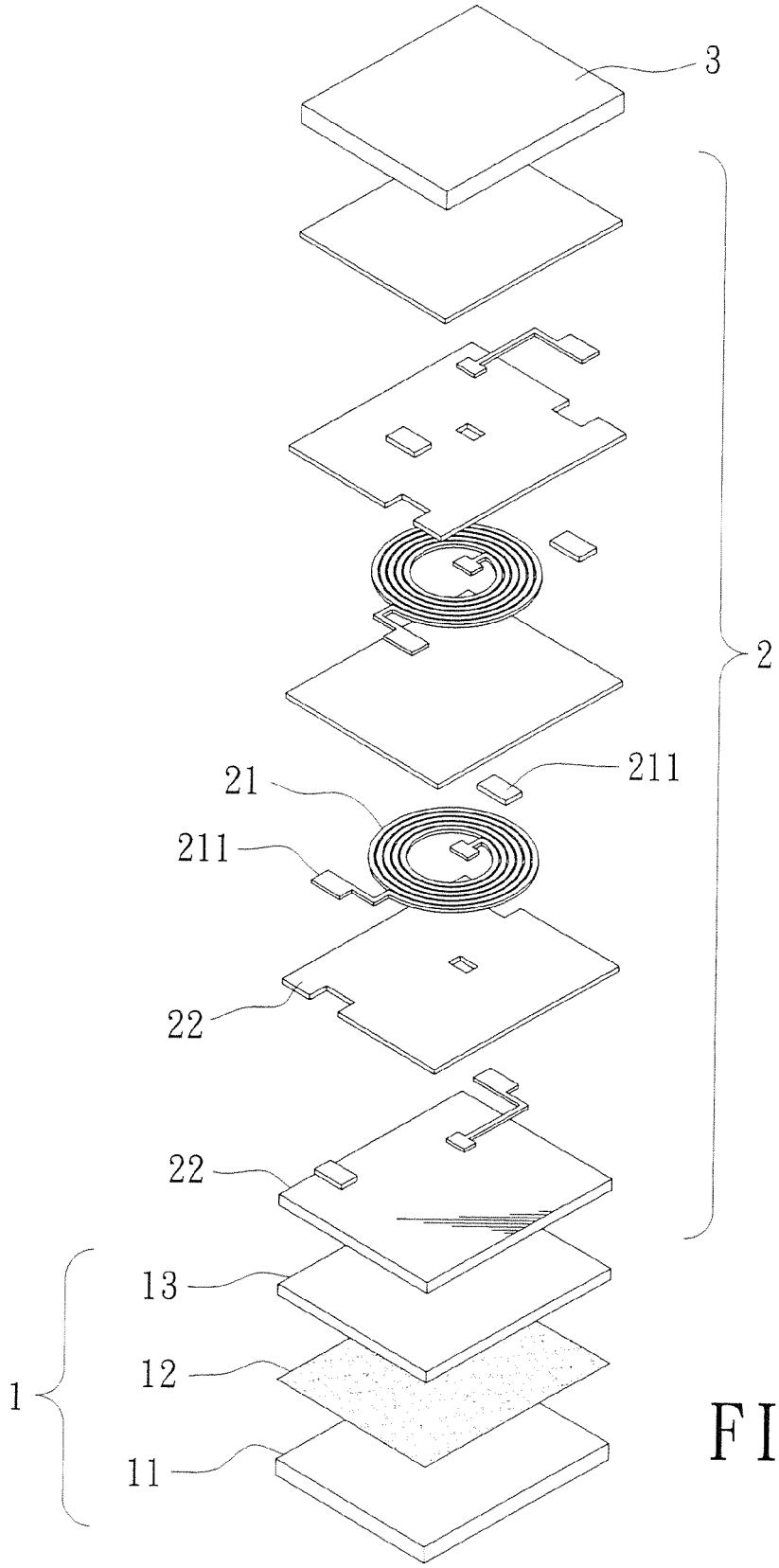
FIG. 13 is an explosive view of another embodiment according to the present invention.
Figure 14:
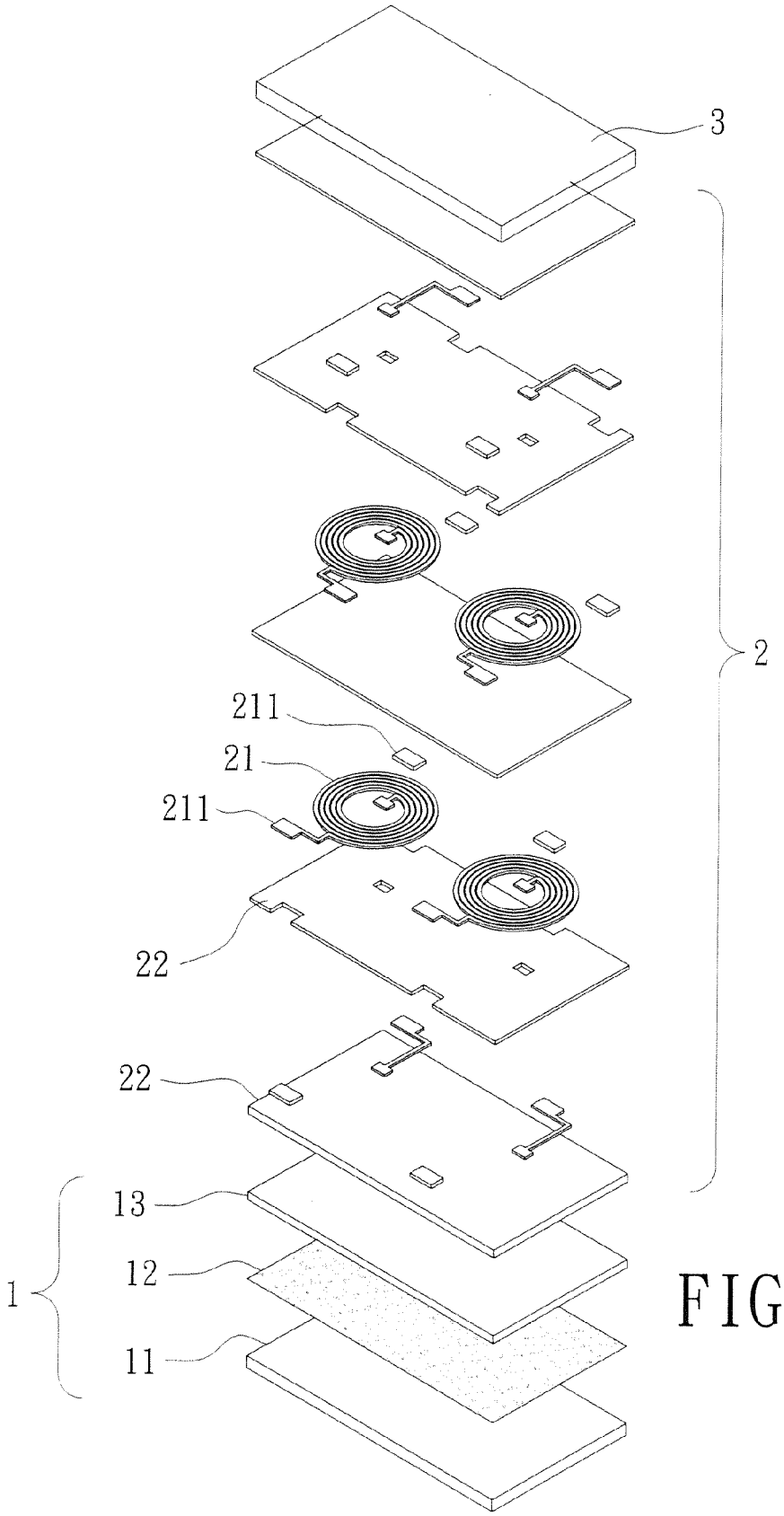
FIG. 14 is an explosive view of a further embodiment according to the present invention.

In addition, the inductive coils 21 arranged between the insulated layers 22 of the common mode choke layer 2 can not only be wound into flat rectangular coils. Refer to FIG. 13 and FIG. 14, the inductive coils 21 can also be wound into circles, looks like a swirl.

In summary, compared the present invention with the structure available now, the present invention makes the composite substrate have stronger support so as to minimize the size of the common mode filter. Thus the common mode filter becomes compact. Moreover, the base layer made from alumina or silicon has good surface properties, provides excellent flatness, and reduces electricity loss. The cost of the base layer is low and the base layer is easy to process. Furthermore, the external electrodes leading out processes are performed at the wafer level. Compared with conventional manufacturing way in which packaging is done after the wafer being cut into pieces, the wafer-level manufacturing processes are favored due to the compact size, reduced rejection rate, easy mass-production and cost reduction. At the same time, the connection and conduction between the inductive coils and the external electrodes are more simple and easier. Therefore the common mode filter of the present invention is of higher practical value.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A manufacturing method of common mode filters comprising the steps of:

Step A: manufacturing a composite substrate that includes a base layer, an adhesive layer over the base layer, and a first magnetic material layer coated over the adhesive layer;

the base layer and the first magnetic material layer sintered and connected by the adhesive layer so as to form the composite substrate;

a particle size of magnetic material of the first magnetic material layer is smaller than 10 μm and a thickness of the first magnetic material layer ranges from 20 μm to 80 μm;

Step B: forming a common mode choke layer over the composite substrate;

the common mode choke layer having a plurality of inductive coils and a plurality of insulated layers while the inductive coil including at least a pair of leading-out terminals;

a second magnetic material layer is coated over an upper surface of the common mode choke layer for forming a plurality of common mode filters on the same composite substrate;

a particle size of magnetic material of the second magnetic material layer ranges from 34 μm to 80 μm and a thickness of the second magnetic material layer is about 50 μm to 150 μm;

Step C: performing a first cutting by means of a cutting tool to form a groove between two common mode filters;

the cutting tool cuts the second magnetic material layer and the common mode choke layer so that the leading-out terminals are located on sides of the common mode choke layer;

Step D: forming external electrodes in the groove by sputtering, lithography and electroplating sequentially and allowing the external electrodes connected to the leading-out terminals of the inductive coils;

the external electrode extending to an upper surface of the second magnetic material layer so as to form a conductive part; and Step E: cutting the composite substrate along the groove by a cutting tool to complete production of a plurality of single common mode filters.

2. The method as claimed in claim 1, wherein the base layer is made from alumina (Al2O3).

3. The method as claimed in claim 1, wherein the base layer is made from silicon (Si).

4. The method as claimed in claim 1, wherein the base layer is disposed with a plurality of receiving slots; both the adhesive layer and the first magnetic material layer is disposed inside each receiving slot; the base layer is sintered and connected to the first magnetic material layer by the adhesive layer inside each receiving slot.

5. The method as claimed in claim 1, wherein a plurality strips of the first magnetic material layer is disposed over the base layer and an adhesive layer is arranged between the base layer and respective first magnetic material layer so that the base layer and each first magnetic material layer are sintered and connected by the adhesive layer.

6. The method as claimed in claim 1, wherein the inductive coils arranged between the insulated layers are wound into flat rectangular coils.

7. The method as claimed in claim 1, wherein the inductive coils arranged between the insulated layers are wound into circles.

* * * * *